US006638121B1

(12) United States Patent
Walker et al.

(10) Patent No.: US 6,638,121 B1
(45) Date of Patent: Oct. 28, 2003

(54) STACKED CONNECTOR WITH LEDS AND METHOD OF PRODUCING THE SAME

(75) Inventors: Kevin E. Walker, Hershey, PA (US); Leonard K. Espenshade, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/264,450

(22) Filed: Oct. 4, 2002

(51) Int. Cl.[7] ..... H01R 9/24
(52) U.S. Cl. ..... 439/885
(58) Field of Search ..... 439/885; 29/883, 29/884

(56) References Cited

U.S. PATENT DOCUMENTS 4,189,085 A * 2/1980 Penrod ..... 228/173.1
4,616,416 A * 10/1986 Cabaud ..... 29/884
4,978,317 A 12/1990 Pocrass
5,362,257 A 11/1994 Neal et al.
6,116,946 A 9/2000 Lewis et al.
6,127,392 A * 10/2000 Lennox et al. ..... 514/352
6,159,039 A 12/2000 Wu
6,162,089 A 12/2000 Costello et al.
6,183,292 B1 2/2001 Chen et al.
6,227,911 B1 5/2001 Boutros et al.

* cited by examiner

*Primary Examiner*—Lynn Feild
*Assistant Examiner*—Phoung Dinh
(74) *Attorney, Agent, or Firm*—Wei Te Chung

(57) ABSTRACT

An electrical connector (1) has a metal shield (3), a main housing (5), a pair of light-emitting devices (LEDs, 6) received in the main housing, a subassembly (7) assembled to the main housing, a stacked Universal Serial Bus connector (USB) 4, and a molded assembly (2) assembled to the subassembly. Each LED (61, 62) has a plurality of leads (611, 621), a free end (612) of the middle lead of the LED is bent perpendicularly and extending horizontally thereafter below the other leads. The molded assembly comprising a plastic part (24), and a first and second contact elements (22, 23) insert molded in the plastic part. The free ends of the leads are respectively electrical connecting soldering sections (221, 231) of the first and second contact elements.

1 Claim, 9 Drawing Sheets

STACKED CONNECTOR WITH LEDS AND METHOD OF PRODUCING THE SAME

CROSS-REFERENCE TO RELATED APPLICATION

This present application is related to a U.S. patent application Ser. No. 10/232,879, invented by Iosif R. Korsunsky et al., filed on Aug. 29, 2002, entitled "MODULAR JACK ASSEMBLY HAVING IMPROVED POSITIONING MEANS"; Ser. No. 10/234,567 filed Sep. 3, 2002, invented by Leonard Kay Espenshade, entitled "SHIELDED ELECTRICAL CONNECTOR ASSEMBLY HAVING RELIABLE GROUNDING CAPABILITIES"; an unknown application serial number, invented by Leonard Kay Espenshade and Kevin Eugene Walker, entitled "STACKED CONNECTOR WITH LEDS"; application Ser. No. 10/236,614 filed Sep. 6, 2002, invented by Leonard Kay Espenshade and Kevin Eugene Walker, entitled "STACKED ELECTRICAL CONNECTOR ASSEMBLY HAVING EASILY DETACHABLE ELECTRONIC MODULE; application Ser. No. 10/236,615 filed Sep. 6, 2002, invented by Leonard Kay Espenshade and Kevin Eugene Walker, entitled "ELECTRICAL CONNECTOR ASSEMBLY HAVING GROUND MEMBER"; and an unknown application serial number, invented by Kevin Eugene Walker, James Henry Hyland, Tod Martin Harlan and Robert William Brown, entitled "STACKED CONNECTOR WITH PLASTIC PART ASSEMBLED THERETO" contemporaneously filed and assigned to the common assignee. Copies of the specifications are hereto attached.

BACKGROUND OF THE INVENTION

1. Field of the Invention

The present invention generally relates to an electrical connector, and more particularly to an electrical connector with light-emitting devices (LEDs).

2. Description of the Prior Art

Following the development of network industry, a variety of types of connectors are proposed to meet different requirements. The connectors general have LEDs for indicating full mating of complementary connectors or operating states of the connectors.

U.S. Pat. No. 6,227,911, issued to Boutros on May 8, 2001, discloses an electrical connector having a housing, and two LED sub-modules. The LED sub-modules have pockets for accommodating LEDs, and grooves for accommodating the leads of the LEDs. The leads of the LEDs extend horizontally before the LEDs are assembled to the LED sub-modules, then the leads of the LEDs are bent vertically after they are assembled to the LED sub-modules. The leads of the LEDs are soldered to a printed circuit board (PCB) of an outer device. However, as the leads of the LEDs are bent downwardly to be soldered to the PCB, as the standard LEDs has a standard length, so the leads of the LEDs can not have enough length to be soldered to the PCB after they are bent if the connectors are a little higher.

U.S. Pat. No. 4,978,317, issued to Pocrass on Dec. 18, 1990, discloses an electrical connector. The electrical connector of Pocrass has a housing, an LED positioned within the housing, the LED has a plurality of lead wires. The housing has a top wall and a bottom wall, the lead wires of the LED extending along the top wall of the housing, bent perpendicular to the bottom wall and extending through the bottom wall and then plug into a PCB. However, as the leads of the LEDs of Pocrass patent are bent downwardly to extend through the PCB, as the standard LEDs has a standard length, so the leads of the LEDs can not have enough length to extend through the PCB after they are bent when the connector is a little higher or be stacked with other connectors.

Hence, an improved connector is needed to eliminate the above mentioned defects of the conventional connectors.

BRIEF SUMMARY OF THE INVENTION

The main object of the present invention is to provide an electrical connector with LEDs that each has two parts leads.

Another object of the present invention is to provide a method of making contact elements which electrically connecting LEDs and printed circuit board (PCB) of an outer device.

An electrical connector of the present invention has an insulative main housing, a subassembly having a magnetic assembly and a contact array assembly, a stacked Universal Serial Bus connector (USB), a molded assembly, and a metal shield. Each LED has a plurality of leads, a free end of the middle lead of the LED is bent perpendicularly and extending horizontally thereafter below the other leads. The molded assembly comprises a plastic part, and a first and second contact elements insert molded in the plastic part. The first and second contact elements have engaging sections, soldering sections, and retaining sections connecting the soldering sections with the engaging sections. The plastic part has a pair of supporting posts extending horizontally on an upper portion thereof. Each supporting posts defines a channel, one of the channel receives one of the soldering sections of the contact elements. The free ends of the leads are respectively soldered to soldering sections of the first and second contact elements.

Other objects, advantages and novel features of the invention will become more apparent from the following detailed description of a preferred embodiment when taken in conjunction with the accompanying drawings.

DETAILED DESCRIPTION OF THE INVENTION

Figure 1:
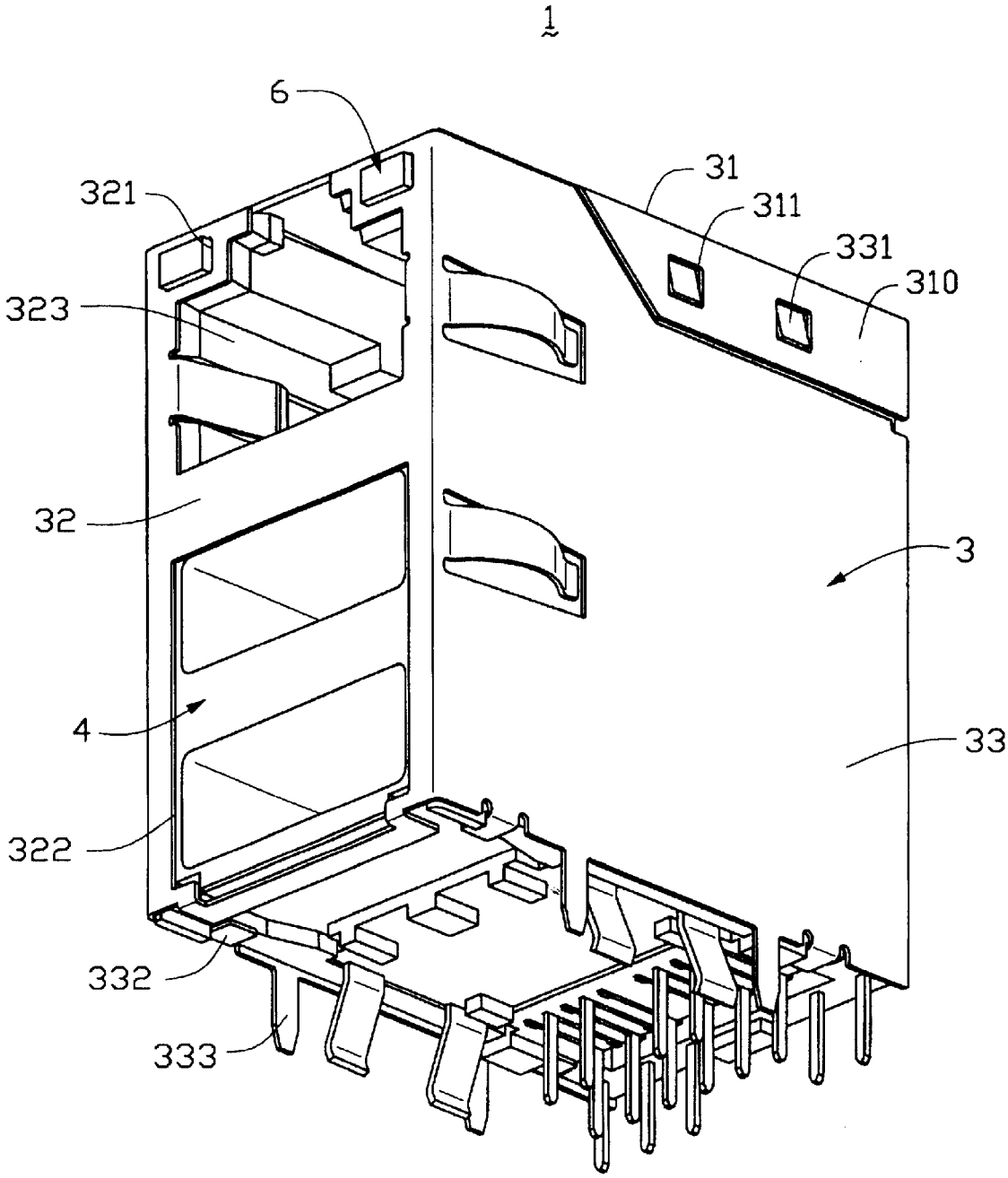
FIG. 1 is a perspective view of an electrical connector of the present invention.
Figure 2:
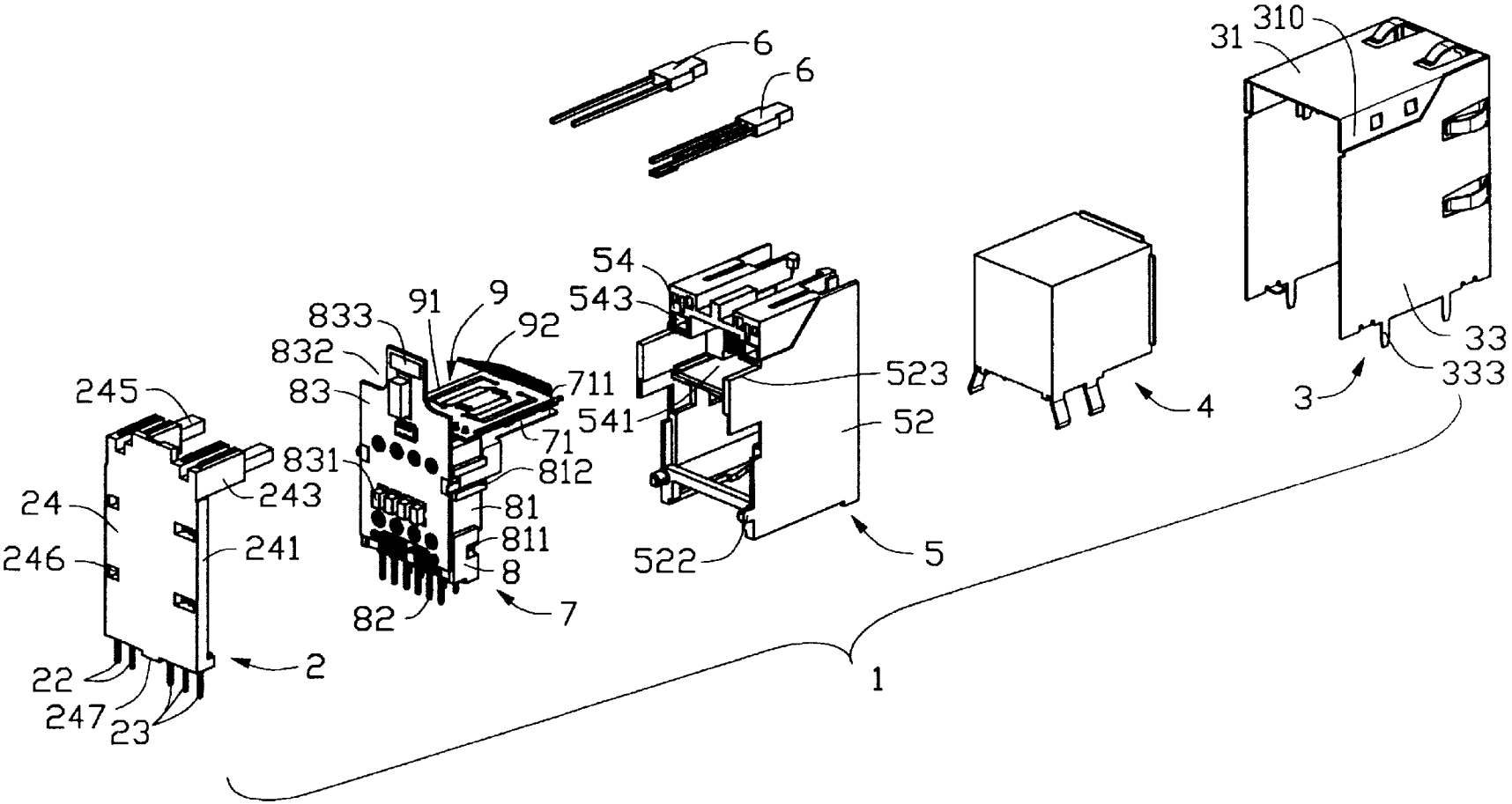
FIG. 2 is an exploded view of FIG. 1.

Referring to FIGS. 1 and 2, an electrical connector 1 of the present invention has a shield 3, a main housing 5, a pair of light-emitting devices (LEDs) 6, a stacked Universal Serial Bus connector (USB) 4, a subassembly 7, and a molded assembly 2.

The shield 3 has a top wall 31, a front wall 32, and two side walls 33. The top wall 31 has a pair of side portions 310 respectively extending from two lateral sides 310. Each lateral side 310 defines a pair of mounting holes 311. Each side wall 33 forms a pair of mounting tabs 331 on an upper portion thereof for engaging with corresponding mounting holes 311 of the top wall 31, and each side wall 33 has a pair of grounding tabs 333 and a pair of retentive tabs 332. The front wall 32 of the shield 3 has a pair of LED receiving cavities 321 on an upper portion thereof, a USB opening 322, and a first opening 323 defined above the USB opening 322.

Figure 3:
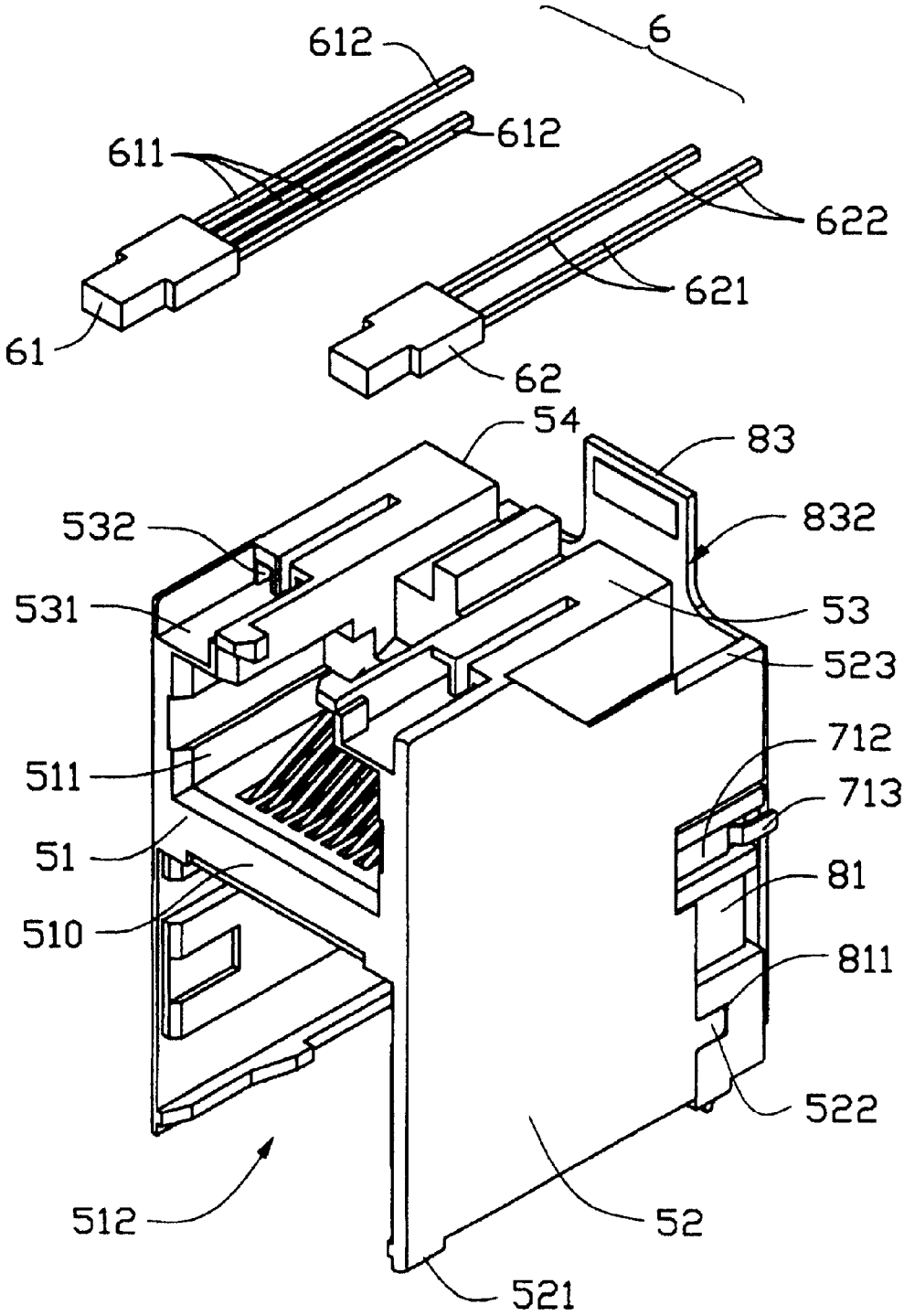
FIG. 3 is a partial assembly view of FIG. 2, with a subassembly and a main housing assembled.

Referring to FIGS. 2 and 3, the main housing 5 is substantially a cubic and has a front wall 51, a pair of side walls 52, a top wall 53 and a rear wall 54. The main housing 5 has a partitioner 510 separating an interior space (not labeled) thereof into a first cavity 511 and a second cavity 512. Each side wall 52 has a standoff 521 extending downwardly from a bottom edge thereof and a locating post 522 extending rearwardly therefrom. The top wall 53 defines a pair of apertures 531 in a front portion thereof and a plurality of passageways 532 communicating with corresponding apertures 531. The rear wall 54 defines a pair of slots 543 respectively adjacent to the side walls 52, and a first groove 541 and a second groove (not shown) respectively above and below the partitioner 510. The side walls 52 of the main housing 5 respectively have bearing portions 523 extending rearwardly from the side walls 52.

The LEDs 6 has a bi-color LED 61 and a single color LED 62. The bi-color LED has three leads 611, one of the leads 611 extends longer than the others. A free end 612 of a middle lead 611 of the bi-color LED 61 is bent downwardly and rearwardly, and then extends parallel to the other leads 611 of the bi-color LED 61. The single color LED 62 has two leads 621, one lead 621 extends longer than the other.

Figure 7:
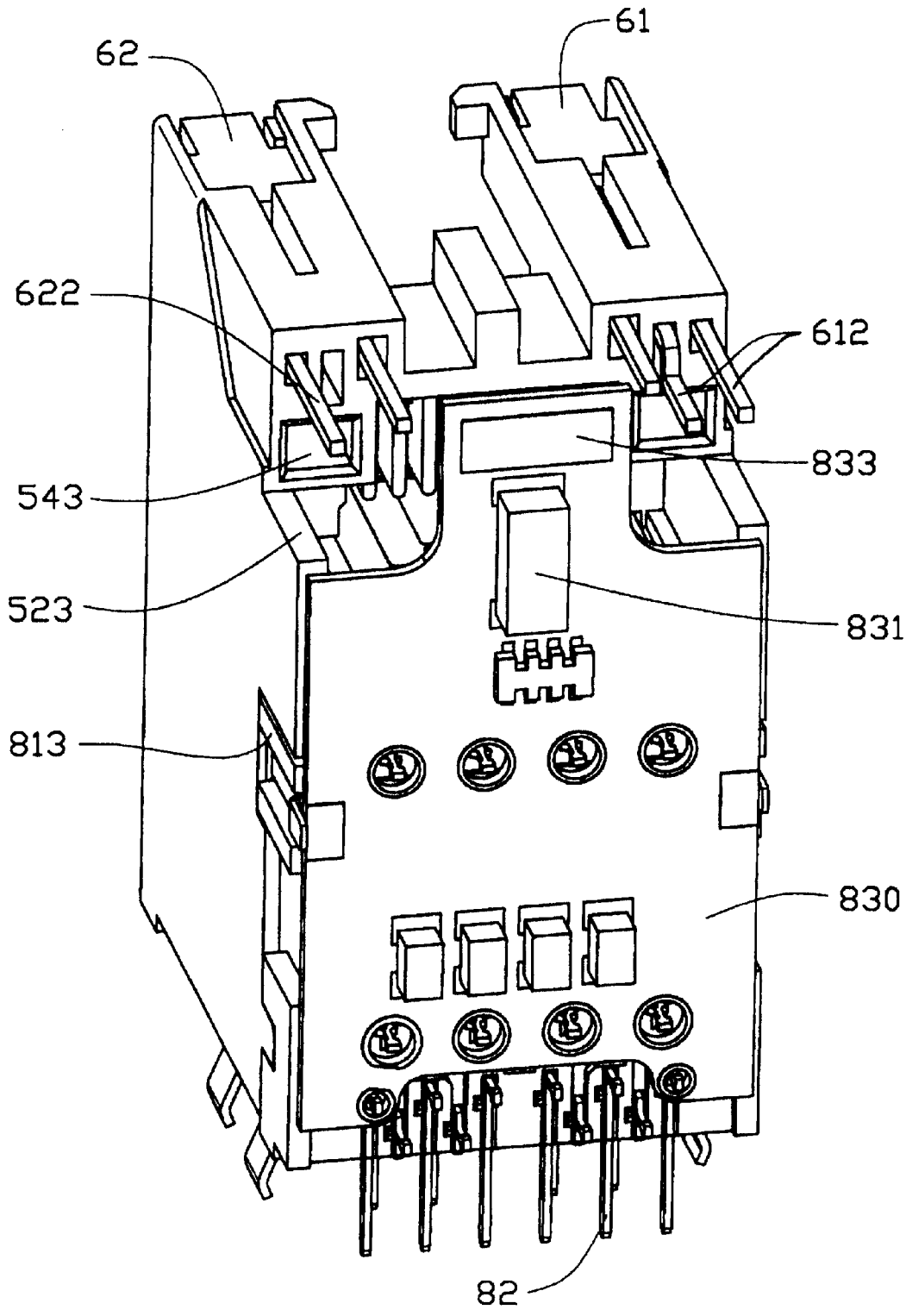
FIG. 7 is a partial assembly view of the electrical connector.
Figure 8:
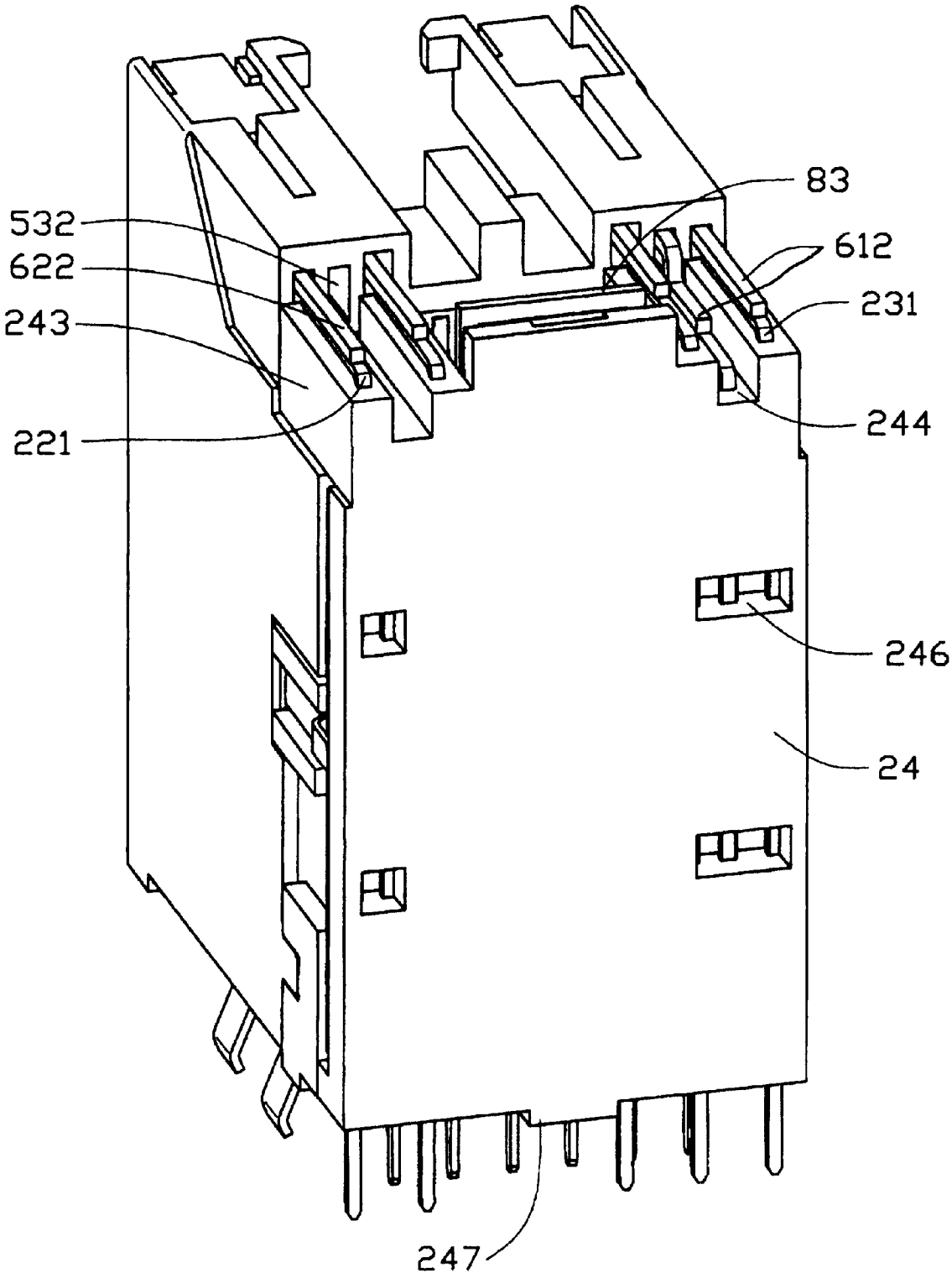
FIG. 8 is another partial assembly view of the electrical connector, wherein a molded subassembly is assembled thereto.

The subassembly 7 has a grounding terminal 71, a magnetic assembly 8 and a contact array assembly 9. The grounding terminal 71 has a flat portion 711, a pair of spring fingers (not labeled) formed on the flat portion 711, a pair of engaging portions 712 respectively extending rearwardly from opposite sides of the flat portion 711, and a pair of grounding tails 713 extending from free ends of corresponding engaging portions 712. The magnetic assembly 8 has a first insulative housing 81, a plurality of magnetic coils (not shown) received in an interior space of the first housing 81, a vertical printed circuit board (PCB) 83 assembled to the first housing 81, and a plurality of signal and grounding contacts 82 received in the first housing 81. The first housing 81 has a pair of recesses 811 adjacent to a bottom portion thereof, two pairs of ribs 813 (shown in FIG. 7) formed on corresponding lateral sides thereof and a recess 812 defined between each pair of ribs 813. The vertical PCB 83 has a plurality of filtering elements 831 arranged thereon, a pair of cutouts 832 defined in an upper portion of the vertical PCB 83, and a pair of grounding pads 833 respectively formed on opposite surfaces thereof. The engaging portions 712 of the grounding terminal 71 are respectively received in corresponding recesses 812 of the first housing 81, and the grounding tails 713 abut against opposite side edges of the vertical PCB 83 of the magnetic assembly 8, thus the grounding terminal 71 straddles the vertical PCB 83. The contact array assembly 9 has a first PCB 91 and a plurality of terminals 92 soldered to the first PCB 91.

Figure 4A:
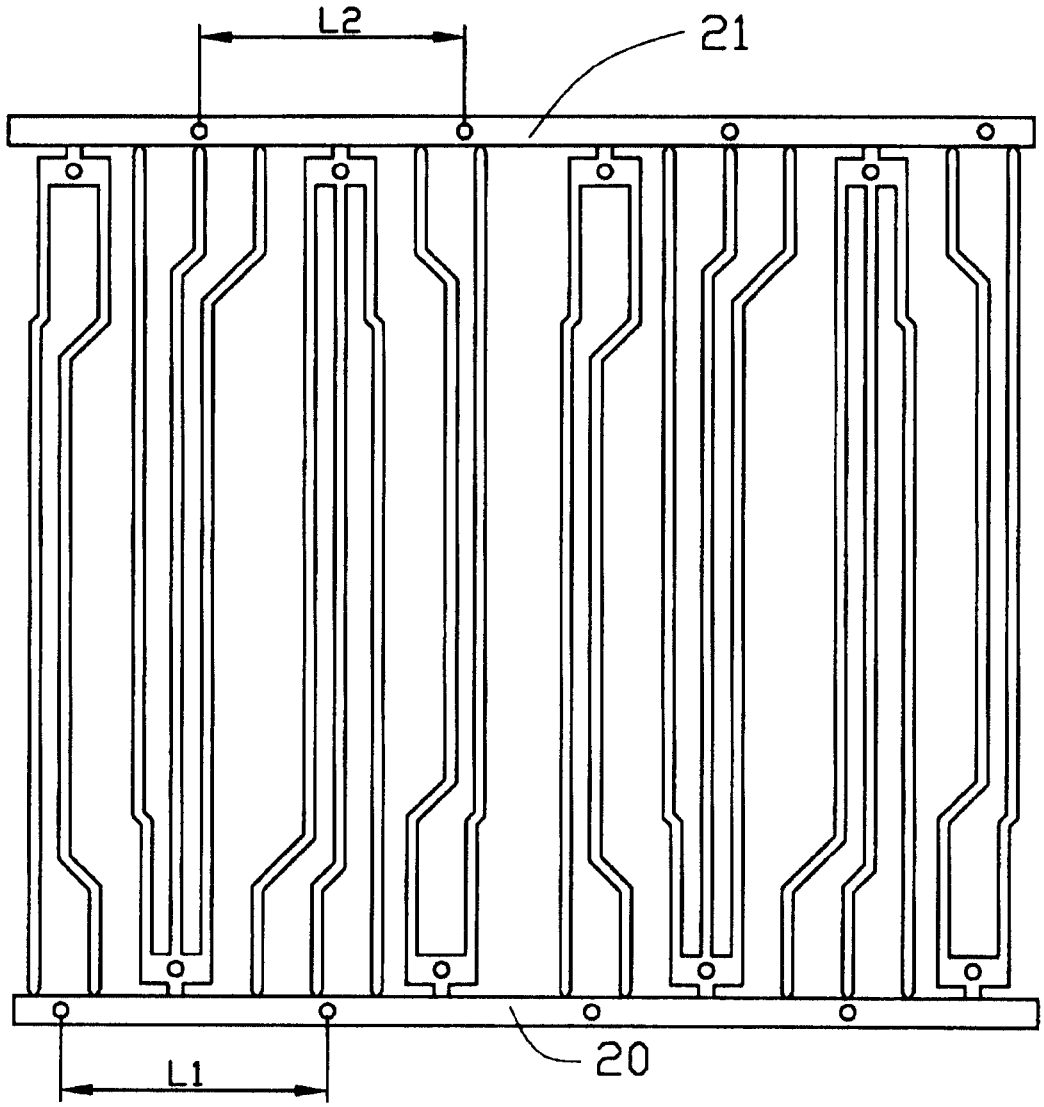
FIGS. 4*a*–4*c* are top views of material strips of contact elements prior to being assembled to the electrical connector.
Figure 4B:
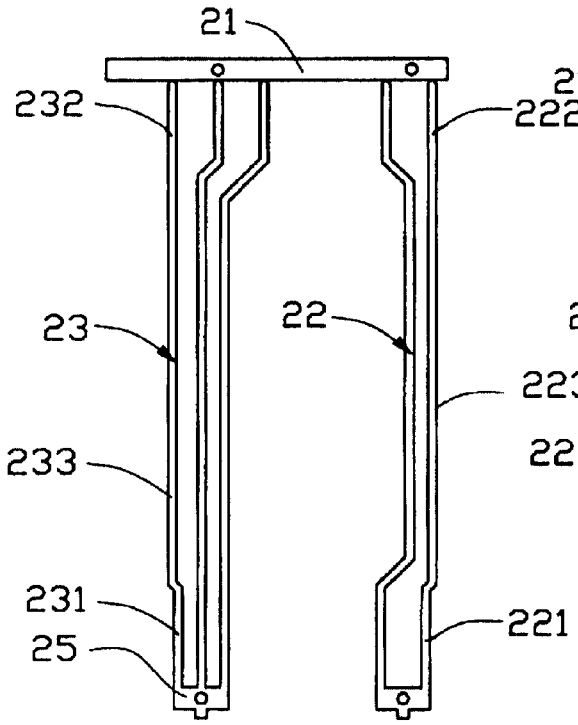
Figure 4C:
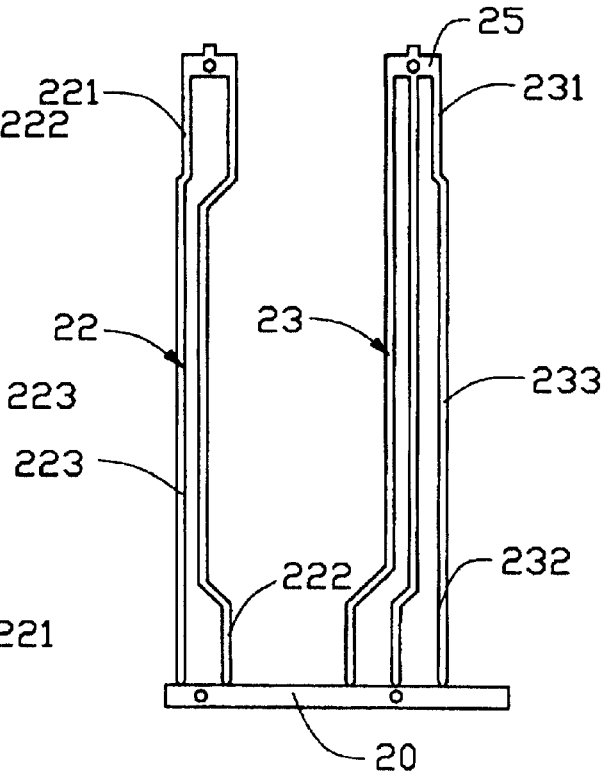
Figure 5:
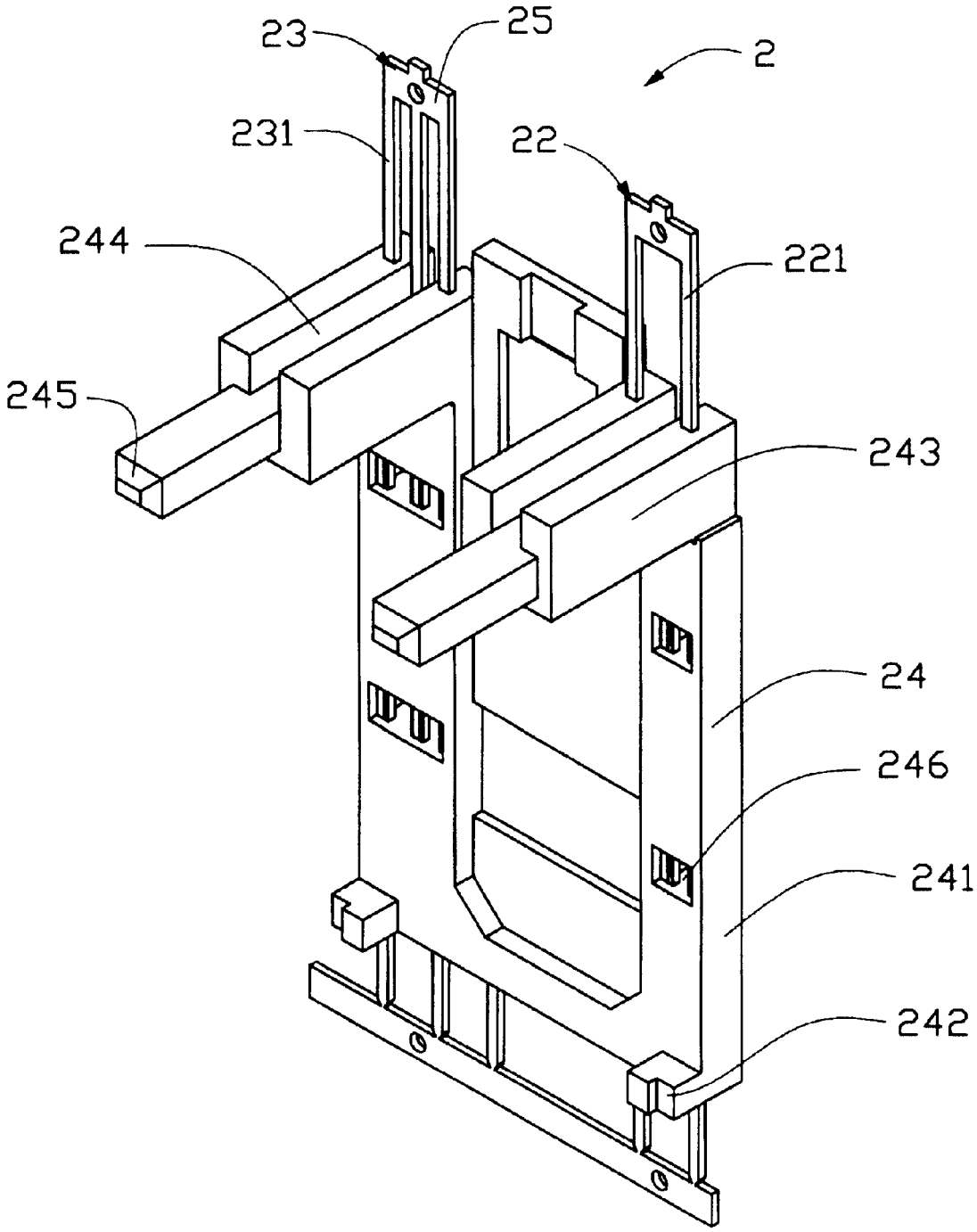
FIG. 5 is a perspective view of a molded assembly of the electrical connector, wherein soldering sections of contact elements insert molded in the molded assembly are not bent.
Figure 6:
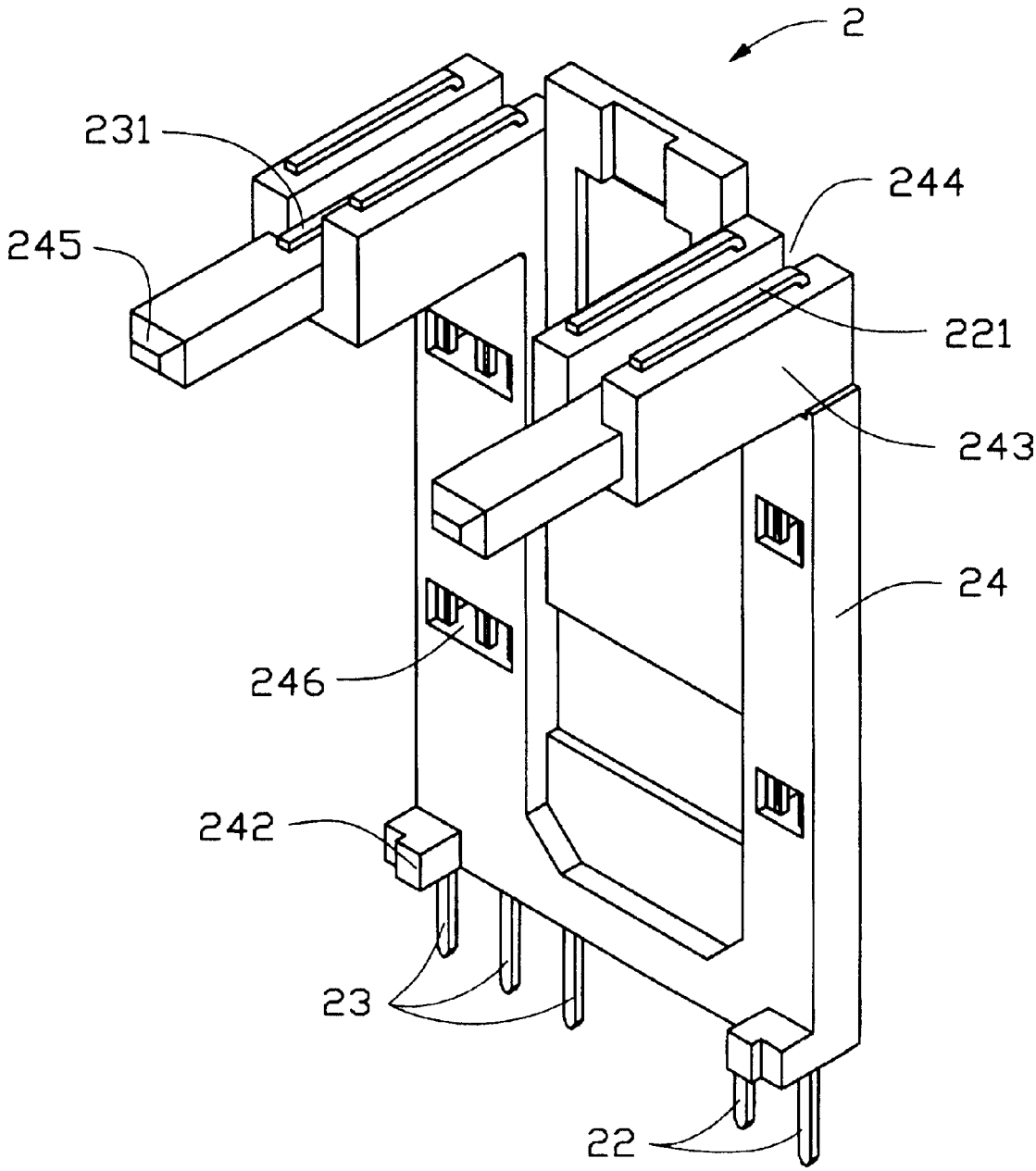
FIG. 6 is a prospective view of a molded subassembly of the electrical connector, wherein soldering sections of contact elements are bent.

Referring to FIGS. 5 and 6, the molded assembly 2 has a plastic part 24 and a pair of contacts (not labeled) molded in the plastic part 24. The plastic part 24 has a body portion 241, opposite protrusions 242 protruding forwardly from a lower portion of the body portion 241, and a pair of supporting posts 243 protruding from an upper portion of the body portion 241. Each supporting post 243 has a positioning post 245 extending from a free end of the supporting post 243. Each supporting post 243 defines a channel 244 in a middle portion thereof. Referring to FIG. 4*a*–4*c*, the pair of contacts has a first contact element 22 and a second contact element 23 and a first and second fingers (not labeled). The first and second contact elements 22, 23 respectively have engaging sections 222, 232 and retaining sections 223, 233 extending from the engaging sections 222, 232. The first and second fingers respectively have soldering sections 221, 231.

Referring to FIGS. 1–8, in assembly, the engaging portions 712 of the grounding terminal 71 engage with corresponding recesses 812 of the first housing 81, and the grounding tails 713 of the grounding terminal 71 abut against lateral sides of the vertical PCB 83. The contact array assembly 9 of the subassembly 7 projects through the first groove 541 into the first cavity 511 of the main housing 5, the grounding terminal 71 projects through the second groove into the second cavity 512 of the main housing 5, the locating posts 522 of the main housing 5 engage with corresponding recesses 811 of the first housing 81 of the subassembly 7, the bearing portions 523 of the main housing 5 are sustained by the ribs 813 of the main first housing 81. The leads 611, 621 of the bi-color LED 61 and single color LED 62 respectively project through corresponding passages 532 of the main housing 5. The bi-color LED 61 and the single color LED 62 are respectively received in corresponding apertures 531 of the main housing 5. The stacked USB 4 is received in the second cavity 512 of the main housing 5. The plastic part 24 of the molded assembly 2 is assembled to the main housing 5 and subassembly 7. The positioning posts 245 are positioned in corresponding slots 543 of the main housing 5. The supporting posts 243 of the plastic part 24 are respectively supported by upper edges of the bearing portions 523 of the main housing 5. The protrusions 242 of the plastic part 24 are received in corresponding depressions (not labeled) of the first housing 81 of the magnetic assembly 8. The retaining sections 223, 233 of the first and second contact elements 22, 23 are exposed from the corresponding openings 246 of the plastic part 24, so that the space between every two retaining sections 223, 233 can be controlled from the opening 246. As the leads 612, 622 of the bi-color LED 61 and the single color LED 62 is a little lower than top surfaces of the supporting posts 243 of the plastic part 24, the soldering sections 221, 231 of the first and second fingers respectively electrically connect with corresponding free ends 622, 612 of the leads 611, 621 tightly. The LED receiving openings 321 of the shield 3 receive corresponding LEDs 6, the first opening 323 and USB opening 322 of the shield 3 are respectively aligned with corresponding first and second cavities 511, 512 of the main housing 5, and the mounting tabs 331 of the side walls 33 of the shield 3 respectively engage with corresponding mounting holes 311 of the top wall 31 of shield 3.

Referring to FIGS. 4*a*–6, a method of making the first and second contacts and a method of inserting the first and second contacts with the plastic part 24 has following steps:

(a) stamping a metal sheet into a first edge 20, a second edge 21, pairs of first and second contact elements 22, 23, and pairs of first and second fingers respectively extending from the first and second contact elements 22, 23, the first pair of first and second contact elements 22, 23 extending from the first edge 20 toward the second edge 21, the first pair of first and second contact elements 22, 23 respectively having connecting portions 25 respectively connecting the first and second contact elements 22, 23 to the second edge 21, engaging portions 222, 232 respectively connecting the first and second contact elements 22, 23 to the first edge 20, and retaining portions 223, 233 extending from corresponding engaging portions 222, 232, the second pair of first and second contact elements 22, 23 extending from the second edge 21 toward the first edge 20, the second pair of the first and second contact elements 22, 23 respectively having connecting portions 25 respectively connecting the second pair of the first and second contact elements 22, 23 to the first edge 20, engaging portions 222, 232 respectively connecting the first and second contact elements 22, 23 to the second edge 21, and retaining portions 223, 233 extending from corresponding engaging portions 222, 232, each of the first and second fingers having a soldering portion 221, 231, and the first and second pairs of the first and second contact elements 22, 23 and the first and second pairs of the first and second fingers being crossways stamped;

(b) a first distance L1 between the first pair of the first and second contact elements 22, 23 having the connecting portions 25 connecting to the second edge 21 being equal to a second distance L2 between the second pair of first and second contact elements 22, 23 having the connecting portions 25 connecting to the first edge 20;

(c) severing the connecting portions 25 of the first pair of the first and second contact elements 22, 23 from the first edge 20, and severing the connecting portions 25 of the second pair of the first and second contact elements 22, 23 from the second edge 21 at the same time;

(d) insert molding the first and second pairs of the first and second contact elements 22, 23 in corresponding plastic parts 24, then severing the first edge 20 and second edge 21 and the connecting portions 25 from the first and second pairs of the first and second contact elements 22, 23;

(e) bending the first and second soldering sections 221, 231 of the first and second fingers toward corresponding supporting posts 243 of the plastic part 24, and the first and second soldering sections 221, 231 extending forwardly and parallel to corresponding supporting posts 243, the middle soldering section 231 of the second finger being bent and received in the channel 244 of the plastic part 24.

In use, the electrical connector 1 is disposed on a PCB of a peripheral equipment (not shown), the grounding tabs 333 engaging with the PCB of the peripheral equipment, the contacts 82 of the subassembly 7 engage with proper circuit traces of the PCB of the peripheral equipment, and the grounding tabs 333 connect grounding circuit traces of the PCB of the peripheral equipment.

One feature of the invention is to provide an economic arrangement for a contact strip with the carrier band and the contact pieces thereof. The traditional way generally forms the contact strip with a plurality of spaced contact elements integrally connected by a carrier band linked on ends of the contact element on the same side of the contact strip. Anyhow, the remaining portions other than the selected contact elements and the associated carrier band are stamped and taken away as the waste material. Differently in the invention, such waste material is also arranged as another set of contact elements carried by another carrier band located on the other side of the original contact strip. Under this situation, the contact elements of these two opposite sets of contact elements with their associated carrier bands are alternatively and symmetrically arranged on the original contact strip, thus saving the material as doubled. Understandably, this economic way may be applied to the contacts inserted into the corresponding passageways in other type connectors as long as the remaining material between the two adjacent contact elements may afford to provide/form at least one contact element. For example, some contact requires only single pitch tail or retention portion while double or even triple pitch mating portion on the contact strip. Under this situation, another set of contact elements with the associated carrier band may be oppositely/alternately arranged with the original set of contact elements and their own carrier band to share the same row contact strip without interference, wherein one contact element of one carrier band and an adjacent contact element of the other carrier band are substantially not overlapped in a width direction perpendicular to the lengthwise direction of the contact strip so as to keep the smaller width of the contact strip, in comparison with other type material-saving arrangements of the contact elements along the contact strip.

It is to be understood, however, that even though numerous, characteristics and advantages of the present invention have been set forth in the forgoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An arrangement of contacts from a raw metal sheet for use with an electrical connector, comprising:

a carrier strip defining, along a lengthwise direction thereof, opposite parallel first and second edge sections on two sides thereof, and defining a contact-forming region between;

a first set of spaced contact elements stamped from said contact-forming region and respectively linked to the first edge section; and a second set of spaced contact elements stamped from said contact-forming region and respectively linked to the second edge section; wherein said first set of spaced contact elements and said second set of spaced contact elements are oppositely and alternately arranged in said contact-forming region along said lengthwise direction.

* * * * *